US006386781B1

(12) United States Patent
Gueret

(10) Patent No.: US 6,386,781 B1
(45) Date of Patent: May 14, 2002

(54) UNIT FOR PACKAGING AND APPLYING A LIQUID PRODUCT

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/055,899

(22) Filed: Apr. 7, 1998

(30) Foreign Application Priority Data

Apr. 15, 1997 (FR) ..... 97 04624

(51) Int. Cl.[7] ..... B48K 5/00
(52) U.S. Cl. ..... 401/198
(58) Field of Search ..... 401/148, 198, 401/199, 202, 153

(56) References Cited

U.S. PATENT DOCUMENTS

| | | | | | |
|---|---|---|---|---|---|
| 2,547,287 | A | | 4/1951 | Sanders et al. | |
| 2,975,464 | A | * | 3/1961 | Schultz | 401/198 |
| 3,089,182 | A | * | 5/1963 | Lofgren | 401/199 |
| 3,132,370 | A | * | 5/1964 | Capezzuto | 401/202 |
| 3,133,308 | A | * | 5/1964 | Claypool | 401/202 |
| 3,133,309 | A | * | 5/1964 | Miles | 401/202 |
| 3,428,404 | A | | 2/1969 | Ciancio | |
| 3,463,597 | A | * | 8/1969 | Wakai | 401/198 |
| 4,480,940 | A | | 11/1984 | Woodruff | |
| 5,492,426 | A | * | 2/1996 | Gueret | 401/148 |

FOREIGN PATENT DOCUMENTS

| | | | | |
|---|---|---|---|---|
| DE | 85 16 042 | | 9/1985 | |
| DE | 86 27 997 | | 6/1988 | |
| EP | 0 435 758 | | 7/1991 | |
| EP | 0 721 748 | | 7/1996 | |
| FR | 84498 | * | 7/1963 | 401/198 |
| GB | 1074908 | | 7/1967 | |
| GB | 2 132 883 | | 7/1984 | |
| JP | 48-79852 | | 10/1973 | |
| JP | 51-18869 | | 2/1976 | |
| JP | 55-76612 | | 6/1980 | |
| JP | 57-121580 | | 7/1982 | |
| JP | 59-135011 | | 8/1984 | |
| JP | 62-132956 | | 8/1987 | |
| JP | 62-151810 | | 9/1987 | |
| JP | 1-88776 | | 6/1989 | |
| JP | 1297-476 A | * | 11/1989 | 401/198 |
| JP | 2-124858 | | 10/1990 | |
| JP | 2-146517 | | 12/1990 | |
| JP | 3-30902 | | 3/1991 | |
| JP | 8-310554 | | 11/1996 | |
| WO | 80/02261 | | 10/1980 | |

* cited by examiner

*Primary Examiner*—Charles R. Eloshway
(74) *Attorney, Agent, or Firm*—Oblon, Spivak, McClelland, Maier & Neustadt, P.C.

(57) ABSTRACT

A unit (1) for packaging and applying a liquid product (P) includes a reservoir (2) containing the product and having a neck (4), a free edge which defines an opening (8); a removable part (5) for closing off the opening in a leaktight manner; and an applicator (10) in the form of at least one block (12) of foam with open or semi-open cells capable of being loaded with product by pumping and fitted inside the neck. The applicator includes a first end (13) in permanent liquid communication with the product inside the reservoir and a second end (14) opposite the first end (13), the second end (14) forming an application surface (15) which is movable axially between a first position in which the application surface (15) emerges outside the neck (4) through the opening (8) in order to apply the product, and a second position in which the application surface (15) is contained in a leaktight manner inside the reservoir (2). The applicator has at least one block (12, 12', 12") of an absorbent material which is capable of being compressed at least partially, particularly when the product is applied or when the applicator is in the second position.

43 Claims, 5 Drawing Sheets

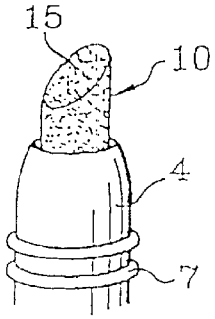
FIG.4A
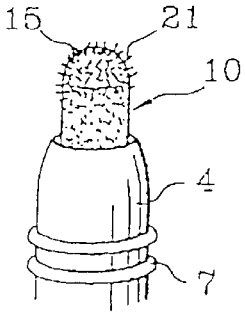
FIG.4B
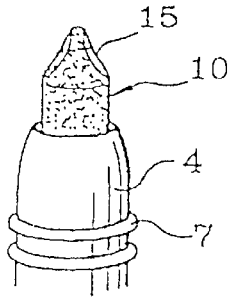
FIG.4C
FIG.4D
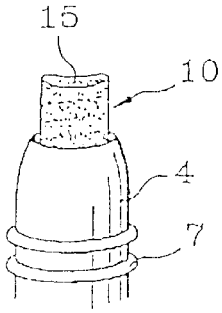
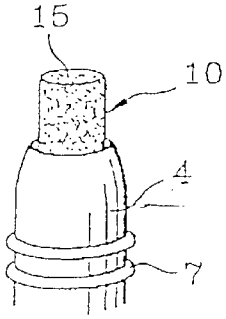
FIG.4E
FIG.5
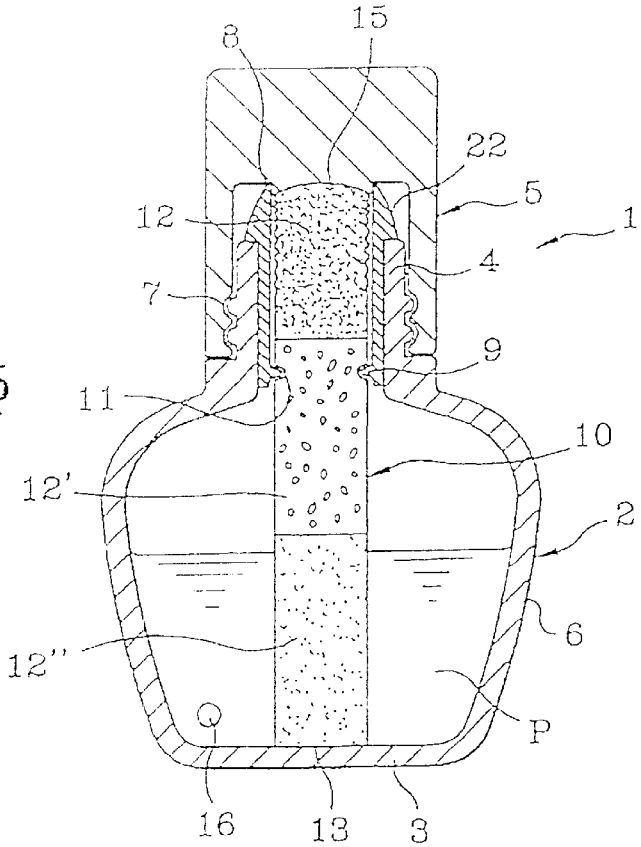

UNIT FOR PACKAGING AND APPLYING A LIQUID PRODUCT

BACKGROUND OF THE INVENTION

1. Field of the Invention

The present invention relates to a unit for packaging and applying a liquid product. The invention is most particularly suited to the packaging and application of cosmetic products such as nail varnishes, lipsticks, oils, gel-type oils, etc. Applications in fields other than cosmetics may also be envisaged, particularly in the field of glues, writing correctors, household stain removers, etc. Liquid products with a viscosity between that of water and that of an oil, even a gel-type oil, are particularly suitable for use according to the present invention.

2. Description of the Related Art

Stain-remover-pad-type devices exist which consist of a product reservoir surmounted by a neck at the top of which is an applicator in the form of a thin foam pad which is applied to a surface to be treated, for example the skin or a fabric. As the applicator pad is confined in the top part of the neck, loading the pad with product requires it to be turned upside down and its surface pressed several times on the surface to be treated in order to prime and load it with product. The pressure exerted on the applicator causes the opening of a valve which, in the closed position, separates the applicator from the product. Such applicators generally contain formulations which include polymers which dry up rapidly when they are not used because they are too far from the solvent medium surrounding the product contained in the reservoir and physically separated from the liquid by valve or pump-type means.

In the case of other products of the polish type, the applicator pad is separated from the product by means of a valve which further accelerates the drying-up of the applicator, sometimes rendering it unusable after a long period during which it has not been used, or requiring cleaning operations prior to any further use.

Furthermore, applicators are known which are in the form of a block of foam which is soaked in the product to be applied and then, after wiping, either on the neck of the flask or by means of a mechanical wiping device, is applied to the surface to be treated. The applicator is generally secured to the top. In certain circumstances, however, it is difficult to use, for example in the case of public transport, owing to the independent nature of the applicator and of the reservoir which, under certain use conditions, means that the container has to be held in one hand and the product applied with the other.

Patent application EP-A-O 721 748 describes an applicator for a viscous cosmetic product which has a body forming a reservoir for the cosmetic product and an applicator member which can be moved between a closed position in which the applicator member is completely engaged inside the body and an open position, in which the applicator member projects outside the body of the applicator, which can be closed by a top when the applicator member is located inside. Closing-off means are provided in order, in the closed position of the device, to prevent any liquid communication between the reservoir and the applicator. Such closing-off means enables the solvent evaporating above the surface of the product to come into contact with the applicator so as to limit the risks of drying-out, but rules out the possibility of having the applicator ready for use when the top is removed.

Patent application EP-A-435 758 describes an applicator for a perfume or other product, which includes a flask delimiting a base and, at the end opposite the base, a permeable top for applying the product, particularly to the skin. The permeable top is supplied with product by capillary effect via, in particular, a wick or a capillary tube. One of the problems associated with such a design is linked to the supply of the applicator end-piece. This supply, essentially by capillary effect, requires a certain period of time to elapse between two applications. Moreover, a method of supply of this type does not allow the application surface to be supplied with products containing pigments of the type which may be encountered in the cosmetics industry, particularly mascaras, nail varnishes or the like.

SUMMARY OF THE INVENTION

Therefore, one of the objects of the invention is to provide a packaging and application unit which is automatic, clean, and easy to use in all circumstances.

A further object of the invention is to provide a packaging and application unit in which the applicator does not dry out substantially and is therefore always ready for use, even after a long period during which it is not used.

Yet another object of the invention is to provide a reliable system which is economical to produce.

According to the invention, these and other objects are achieved by producing a unit for packaging and applying a liquid product, comprising a reservoir containing the product and having an opening; removable means for closing off the opening in a leaktight manner; an applicator fitted inside the reservoir, the applicator including a first end in permanent liquid communication with the product inside the reservoir and a second end opposite the said first end. The second end forms an application surface which is movable axially between a first position in which the application surface emerges outside the reservoir through the opening in order to apply the product and a second position in which the application surface is contained inside the reservoir. The applicator comprises at least one block of an absorbent material which is capable of being compressed at least partially, particularly when the product is applied or when the applicator is in the second position. In the second position, the application surface is preferably contained in the neck.

Thus, when the compressed block of foam relaxes, either after an application, upon opening of the cap which may keep it compressed, or at the time of any other decompression phase, it pumps product via the open or semi-open cells which form it so that the applicator is always laden with product and thus always ready for a further application. In other words, the applicator is loaded with product essentially by compression/decompression of the compressible and absorbent part of the applicator. By using an applicator which has open or semi-open cells appropriate to the size of any pigments contained in the product, products can be pumped which could not be pumped with conventional applicators of the "felt" or wick type.

The expression "permanent liquid communication" reflects the fact that, at all times, both in the application position (first position) and in the storage position (second position), at least the first end of the applicator is in contact or capable of coming into contact with the liquid contained in the reservoir. In other words, it is not physically separated from the product by a valve, a pump or by any other closing-off means. This is reflected in the fact that either the first end soaks in the product or it is connected by means of a wick-type member soaking in the product or it is quite simply contained physically within the same volume (above the free surface of the product) so that, at the time of a movement such as may arise from transporting the unit, the first end cannot fail to be placed in contact with the product. As the applicator includes at least one foam-type block with open or semi-open cells, which is capable of pumping the liquid, it will always be loaded, or even saturated, with product and will thus always be ready for use. The actual pumping of the product is principally mechanical (compression/relaxation of the foam). Moreover, in the case of certain formulations, owing to their rheology, solvent may rise in the direction of the surface of the applicator by means of capillary effect or effect of surface tension with the cells of the block of foam or other alveolar or porous material. This makes it possible to further minimize drying-out of the applicator over a long period during which it is not used.

Advantageously, the reservoir consists of a body, a first end of which is closed by a base and a second end which is surmounted by a neck, the opening being delimited by a free edge of the neck, the applicator being at least partially inside the neck. The inner surface of the neck may have at least one groove, in the form of a helix, for example, so as to improve the air-uptake passage, this air uptake being permitted also by the presence of the open or semi-open cells which form all or part of the applicator. The neck may have an axis which is different from the body axis. Alternatively, the reservoir consists of a tube closed by a weld line. The applicator may be fitted either via the opening of the tube or via the base, before closure. Pressure exerted on the flexible walls of the tube makes it possible, if appropriate, to improve loading of the applicator with product, particularly by means of compression/decompression of a part of the applicator through the walls of the tube.

The first end may be located level with the lower edge of the neck. Preferably, however, the first end emerges substantially inside the reservoir and, in particular, inside the body of the reservoir through the lower part of the neck. Generally speaking, in the non-compressed position, the height of the applicator is preferably at least equal to the height of the neck and, more preferably, at least equal to one and a half times the height of the neck. The volume of air present between the applicator and the product is thus further reduced and this, combined with a good closure seal, prevents the applicator from drying out. The applicator is in effect held in a product-saturated atmosphere and is itself saturated with product. It is thus always ready to use. In the application position, the product does not drip even if the applicator is saturated. Application is clean and may be measured as desired. Application is done by applying the applicator surface to the surface to be treated. Product is released by means of the at least partial compression of the compressible block of the applicator. By compressing the applicator to a greater or lesser extent, the product deposited on the surface is measured appropriately, the hardness of the foam being chosen so that the pressure to be exerted in order to be able to apply a given maximum quantity of product is less than the force needed to move the application surface from the first position (application position) to the second position (return position). Once the product has been distributed, it must be spread uniformly over the surface to be treated. This spreading is achieved by passing the application surface over the surface to be treated, by simple capillary contact, so as to spread the product out in the form of a film through the action of the surface-tension forces being exerted between the application surface and the surface to be treated via the liquid, this taking place without necessarily having to exert pressure on the applicator. Depending on the percentage of open or semi-open cells in the applicator, it will thus be possible to adjust the outflow of the product in accordance with the latter's rheology.

According to a first embodiment, the reservoir has a base opposite the opening, the first end being located substantially in the vicinity of the base so as to be permanently in contact with the product. Whenever the reservoir is opened, or after each compression of the applicator for applying product to a surface to be treated, the block of foam is decompressed, thereby giving rise to a pumping of product in the direction of the application surface. Moreover, between two uses, the solvent contained in the product may, to a certain extent, be pumped into the applicator by means of capillary effect or by the effect of surface tension as far as the application surface.

According to a further embodiment, the first end is located above the level of product in the reservoir. Contact between the applicator and the product takes place quite naturally and automatically whenever the unit is moved during its transportation, for example in the user's handbag. Impregnation of the applicator, particularly with solvent, may be promoted by securing the applicator to a wick-type member soaking in the product.

Advantageously, the reservoir has a base opposite the opening and a body connecting the base to the neck, the base being movable axially with respect to the body so as to facilitate contact between the product and the applicator and to promote loading of the applicator with product. By way of example, the body is connected to the base by means of an extendible, "bellows"-type part. Pressure exerted on the base may make it possible to compress at least a part of the applicator which, by relaxing, will absorb the product.

The applicator may be secured to the neck in an intermediate zone between the first and second ends, the passage from the first position to the second taking place by axial compression of at least that portion of the applicator which is between the application surface and the intermediate zone in response to the closing-off of the opening by the removable closure means. By way of non-limiting example, the applicator is secured to the neck by gluing, welding or by any other appropriate means (fins, tabs, etc.). By way of further example, the inner surface of the neck of the device forms a bead capable of receiving a groove provided all around the applicator.

According to a further embodiment, the applicator is fitted so as to slide inside the neck, the passage from one of the first or second positions to the other takes place by means of an axial translation movement of the entire applicator. Such a sliding movement of the applicator may be produced by ballasting means which are provided on the applicator, the passage from a "head-up" position to a "head-down" position of the packaging and application unit entraining the application surface into the first position, the passage from a "head-down" position to a "head-up" position of the packaging and application unit entraining the application surface into the second position. Preferably, the ballast means consist of weights fixed outside the applicator and inside the reservoir, and thus advantageously form mixing means for homogenizing the product. In this case, the ballast is chosen so that the force needed to insert the applicator into the reservoir is greater than the applicator compression force needed to distribute the desired quantity of product. Advantageously, and in order to make it possible to be able to use the application unit in any position including head-up, means are provided to immobilize the applicator in the first position.

According to yet another embodiment, the reservoir comprises a base in the vicinity of which the first end is located, and a body connecting the base to the neck, the base being movable axially with respect to the body, the applicator being fitted so as to slide inside the neck, means being provided for selectively varying the axial distance between the base and the neck so as to cause the applicator to move from one of the first or second positions to the other, means also being provided to hold the first end of the applicator substantially in the vicinity of the base. Therefore, the base may be connected to the body by means of a portion which forms a bellows. Alternatively, the base is formed by an elastically deformable flexible membrane.

Advantageously, the means capable of selectively modifying the axial distance between the base and the body comprises an attached base which is screwed onto the body of the unit, the screwing operation giving rise to a reduction in the axial height of the reservoir and the exit of the second end from the applicator through the neck of the device.

The means capable of holding the first end of the applicator in contact with the base may include elastic return means, a first end of which bears against a zone located in the vicinity of the neck and a second end of which bears on a zone secured to the applicator. By way of example, these elastic return means are formed by a helical spring.

The applicator may be fitted inside the neck by means of an intermediate member fitted inside the neck. An intermediate member of this type may be fitted inside the neck either forcibly or by snap-fitting, screwing, gluing, welding, etc.

According to an advantageous characteristic of the invention, the applicator is fitted so as to be able to pivot angularly with respect to its axis or with respect to a plane passing through its axis. By way of illustration, the applicator is fitted by means of a pivot mechanism.

Advantageously, the applicator consists of at least one block of foam chosen from polyurethane, polyethylene, polyester, polyvinyl chloride, polyether, NBR (natural rubber), SBR (synthetic rubber) foams, etc. The nature of the foam and the size of the cells forming it are chosen in accordance with the rheology of the material to be applied, in particular its viscosity and its surface tension, and also as a function of the desired outflow of the product. Preferably, the applicator comprises at least 10% of open or semi-open cells.

According to a further embodiment, the applicator consists of a stack of blocks of foam of various types and/or densities and/or thicknesses. This makes it possible to adapt the softness to the application and the quantity of product applied and also makes it possible to adapt the applicator to products with different rheologies. Alternatively, the applicator consists of a stack comprising at least one block of foam and at least one block of a material capable of pumping the product chosen, e.g., from sintered materials of sintered type of polyvinyl chloride, ethylene-vinyl acetate, felts, etc. In this latter configuration, the block of foam is preferably located in contact with the application surface. As mentioned above, the presence of a compressible block makes it possible, in addition to pumping the product at each decompression phase, to measure the quantity of product applied to the surface to be treated.

The application surface may have a variable shape depending on the profile of the surface to be treated. By way of example, the application surface has a shape which is concave, convex, flat, bevelled or double-bevelled, etc.

According to a further advantageous characteristic of the invention, the application surface may be covered with a covering which the product is able to permeate, of textile, perforated plastic or felt type and/or may be covered with a flock coating. Alternatively, the foam may be used directly as an application surface. Good application quality will be obtained particularly by virtue of the surface resulting from cutting the cells at the application surface. Satisfactory cutting quality may be obtained by cutting the foam using a laser or water jet. The cut edges of the cells, oriented perpendicularly to the application surface, i.e., axially with respect to the applicator, will act like the bristles of a paintbrush. Cut edges of this type promote retention of the product and its smoothing over the surface to be treated.

If the application surface is covered with a flock coating, this may consist of pile fibers of different diameters and/or type and/or height, or of a mixture of such pile fibers. The combination of a foam in which the cells have a relatively large average size (typically from 200 $\mu$m to 3 mm and preferably from 700 $\mu$m to 2 mm and more preferably still from 0.1 mm to 1.5 mm) with a flock-coating cover over the application surface has been proved to produce remarkable results.

The application capacity and flow of the product may be increased by forming a narrow channel or one or more slots (in the form of a cross, for example) at the center of the applicator, passing axially through the applicator.

The reservoir may be made from metal, glass or a thermoplastic material chosen from polyethylenes, polypropylenes, polyvinyl chlorides, polyethylene terephthalates, etc. In the case of a thermoplastic material, it may be produced by means of injection-blow molding, extrusion-blow molding or simple injection.

Balls may be provided inside the reservoir so as to promote homogenization of the product and to facilitate impregnation of the applicator.

If the applicator is axially free inside the neck, its first end may be mounted on a spring (for example, made from plastic) bearing against the base of the reservoir. This makes it possible to subject the applicator to a lower compression force when the cap is replaced on the device. The spring is chosen so that the force necessary for its compression is greater than the compression force of the foam required by certain applications as a function of the desired quantity of product.

According to a further variant, the unit according to the invention may comprise two applicators mounted head-to-tail inside the reservoir, the reservoir comprising, in these circumstances, a body whose first end is surmounted by a first neck and whose second end is surmounted by a second neck. Each of the necks has a free edge delimiting a first and a second opening inside which the first and the second applicator, respectively, are fitted. The operation of each of the applicators is identical to that which has been described above. A configuration of this type is particularly advantageous in that it makes it possible to use applicators which have different sizes and/or application characteristics. For example, in the case of a nail varnish, use is made of a first applicator of given section for large fingernails and an applicator of relatively smaller section for small fingernails.

The product may be a cosmetic product such as a nail varnish or a lipstick, or may be a glue, an oil, a gel-type oil, a writing corrector ("Typex"), a stain remover, etc.

BRIEF DESCRIPTION OF THE DRAWINGS

Apart from the arrangements described above, the invention consists of a certain number of other arrangements which will be explained below by way of non-limiting illustrative embodiments described with reference to the appended Figures, among which:

FIGS. 4A–4E illustrate different profiles of the application surface of the packaging and application unit according to the invention;

FIG. 5 illustrates a further embodiment of the device according to the invention;

DETAILED DESCRIPTION OF THE PREFERRED EMBODIMENTS

Figure 1A:
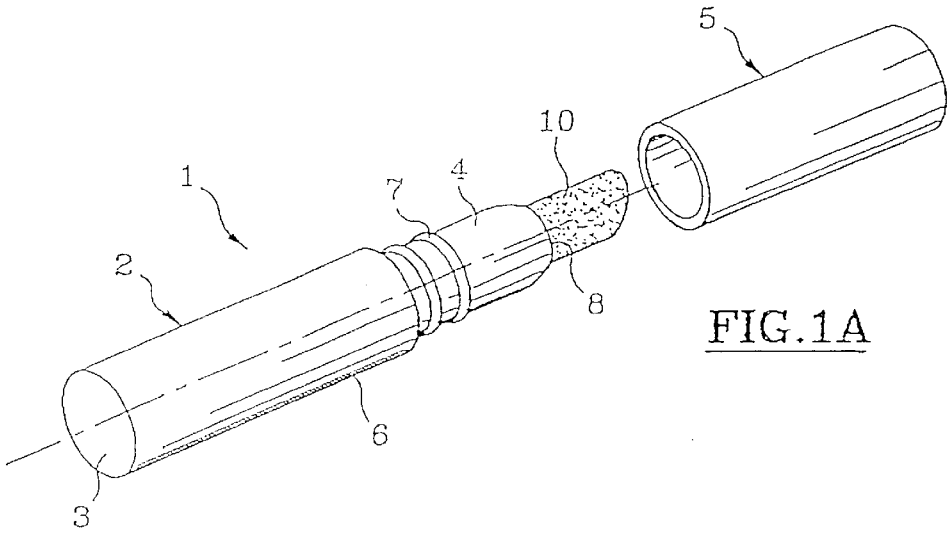
FIGS. 1A–1C illustrate different views of a first embodiment of the unit according to the invention.
Figure 1B:
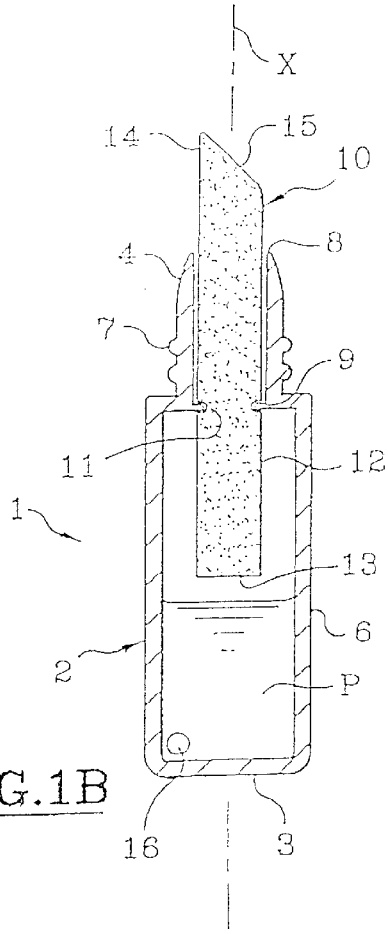
Figure 1C:
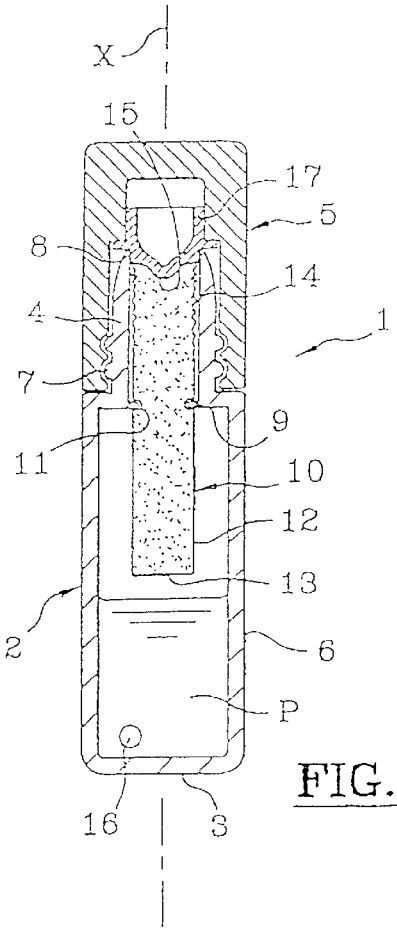

FIGS. 1A to 1C illustrate various views of a first embodiment of the packaging and application unit 1 according to the invention. In this configuration, it has the form of a lipstick case or eye-liner-type case, and principally has a reservoir 2 consisting of a body 6, one end of which is closed off by a base 3. The other end has a neck 4 which has, on its outer surface, means 7 of the screw-thread or snap-fit bead type to allow removable fixing of a top or cover 5 capable of closing off the opening 8 delimited by the free edge of the neck 4 in a leaktight manner.

As may be seen more clearly from FIGS. 1B and 1C, an applicator 10 is securely fixed inside the neck 4. To this end, an annular bead 9 is provided on the inner surface of the neck and is capable of receiving an annular groove 11 provided on the outer surface of the applicator, substantially half way up the applicator, so as to immobilize the applicator axially in the neck. Alternatively, the applicator may be fitted into the neck by means of a system of fins arranged evenly over the inner surface of the neck. The applicator 10 has the form of a block 12 of foam, a first end 13 of which emerges inside the reservoir 2 (substantially half way up the body of the reservoir) so as to be located above the level of product P in the reservoir 2.

The applicator 10 has a second end 14 which, in the closed position of the unit as illustrated in FIG. 1C, is contained inside the neck of the reservoir. According to this Figure, the device is represented with the top 5 closing off the opening 8 delimited by the free edge of the neck 4 in a leaktight manner. To this end, a sealing member 17 is provided inside the top 5. In this position the applicator is partially compressed (in fact, only that part which is between the application surface 15 and the zone where the applicator is fastened to the neck is substantially compressed) by the bearing force exerted by the top 5, and in particular by the member 17, on the application surface. The application surface is located inside the neck 4. A ball 16 is provided in the reservoir so as to allow the product P to be homogenized.

Typically, the applicator has a diameter of from 2 mm to 35 mm and preferably from 3 mm to 20 mm. Its height, in the non-compressed position, may vary from 5 mm to 150 mm.

In FIG. 1B, the device has had its top 5 removed. Upon opening, the block of foam decompresses, which gives rise to pumping of the product. After opening, the block of foam is no longer compressed. In this position, the second end 14 of the foam emerges outside the reservoir 2 above the free edge of the neck 4 delimiting the opening 8. The second end 14 of the applicator 10 defines an application surface 15 whose shape is chosen as a function of the profile of the surface to be treated. In the example shown, the application surface 15 has a bevelled profile. Other profiles will be discussed in greater detail with reference to FIGS. 5A–5E.

In order to use the application unit according to the invention, the user removes the top 5, which gives rise to decompression of the block 12 of foam which forms the applicator and the exit of the application surface 15 from the device 1. This decompression is accompanied by a pumping of product P towards the application surface 15. The applicator is thus saturated with product and may now be used. The device, even turned upside down with a view to applying product, is perfectly leaktight owing to the presence of the product-saturated applicator in the neck of the container. It should be noted that, in such an embodiment, the applicator is placed permanently in contact with the product, particularly at the time of each movement caused by the transportation of the unit in a handbag, for example.

Figure 2A:
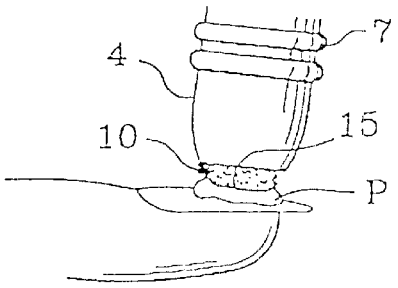
FIGS. 2A–2B illustrate the application of a nail varnish by means of a device in accordance with FIGS. 1A and 1B.
Figure 2B:
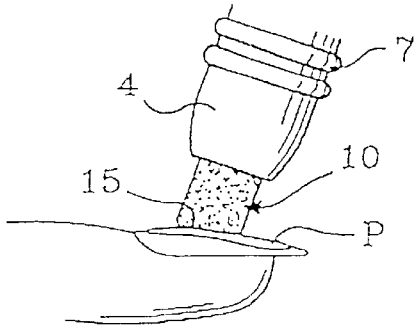

The application operation is illustrated diagrammatically in FIGS. 2A and 2B, in which the application of a varnish to a user's nails has been illustrated. In order to do this, the user turns the application surface 15 upside down over the nail and exerts a pressure on the applicator in accordance with the desired measured amount of product, this pressure giving rise to partial compression of the applicator and acceleration of the exit of the product (FIG. 2A). After having relaxed the pressure exerted on the applicator, it then remains to spread the product out by means of the application surface (FIG. 2B). Relaxing of the pressure of the applicator on the skin is accompanied by pumping of product. The applicator is immediately ready for further use. As mentioned above, spreading-out of product takes place by moving the application surface over the surface to be treated by simple capillary contact, so as to spread the product out in the form of a film through the action of surface-tension forces exerted between the application surface and the surface to be treated, via the liquid, this taking place without exerting pressure on the applicator.

Figure 3:
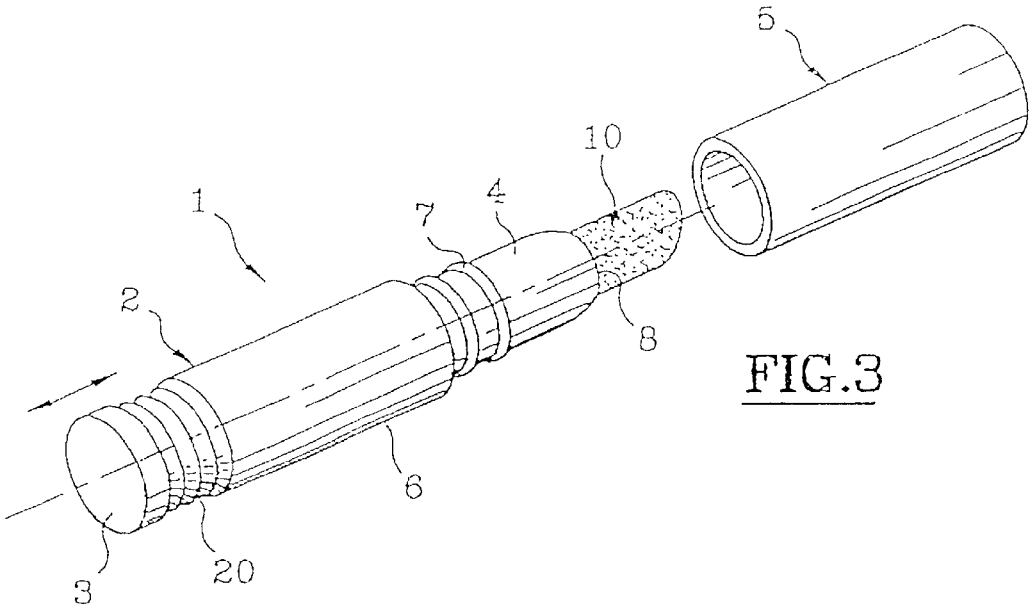
FIG. 3 illustrates a variant of the embodiment in FIGS. 1A–1C.

FIG. 3 illustrates a variant of the embodiment in FIGS. 1A–1C. In this embodiment, impregnation of the applicator is facilitated by the presence of a compressible, bellows-type member 20 provided between the base 3 and the body 6 of the reservoir 2. In the case of a device made from thermoplastic material, the bellows is obtained when the container as a whole is molded. Thus, prior to opening the top 5 with a view to applying product, the user exerts pressure one or more times on the base 3, which has the effect of moving the product P in contact with the applicator and of at least partially compressing the applicator. By relaxing the pressure exerted on the base, the applicator decompresses, thereby giving rise to the pumping of product. It then remains to open the top with a view to a use similar to that described with reference to FIGS. 2A and 2B. Product is also pumped upon opening the top 5 by releasing the end of the applicator compressed in the reservoir. Similarly, the decompression which follows each application also makes it possible to pump a certain quantity of product into the applicator. This embodiment is particularly suited to fluid products with higher viscosity. In all these embodiments, the section of the applicator is circular. Obviously, the applicator may have a section of different shape (circular, triangular, square, oval, teardrop, etc.).

FIGS. 4A–4E illustrate various profiles of the application surface 15. In FIG. 4A, the application surface 15 has a bevelled profile. In FIG. 4B the application surface has a convex profile in the form of a dome. In this version, the application surface is covered with a flock coating 21. The flock coating may include pile fibers of different types and/or lengths and/or diameters, or a mixture of such pile fibers. The flock coating 21 makes it possible, depending on the choice of fibers used, to influence the softness of application and the quantity of product applied. In FIG. 4C, the surface 15 has a double-bevelled profile. In FIG. 4D, the profile of the application surface is slightly concave. In the embodiment in FIG. 4E, the application surface is substantially flat and perpendicular to the axis of the unit.

FIG. 5 shows a further embodiment of the packaging and application unit according to the invention. In this embodiment, the reservoir has the form of a container (made from glass, for example). The applicator is a wick which soaks in the product P and has its first end 13 substantially in contact with the base 3. In the same way as for the preceding embodiment, in the closed position, the top 5 bears on the application surface to compress the applicator at least partially. The applicator is fitted into the neck in the same way as in FIGS. 1A–1C, i.e. by means of a groove 9/trough 11 arrangement, or of a system with fins. However, the applicator is not fitted directly into the neck but into an intermediate piece 22 mounted inside the neck. This piece 22 may be fitted inside the neck by any appropriate technique (gluing, welding, snap-fitting, etc.). Such a configuration permits greater flexibility for the shape of the application end-piece. Moreover, and unlike the embodiment in FIGS. 1A–1C, the applicator consists of a stack of blocks 12, 12', 12" of foam glued end-to-end. The blocks 12, 12', 12" of foam may be of various types and/or hardnesses and/or thicknesses and/or densities. It is thus possible to influence the load of the applicator 10 and its flow. Moreover, this makes it possible more easily to adapt the applicator to the rheology of the product. Alternatively, use may be made of a block of foam in combination with one or more blocks of another material capable of pumping the product P by means of capillary effect or by surface-tension. By way of example, use is made of a block of foam in combination with a block of sintered of polyvinyl chloride, ethylene-vinyl acetate or with a felt. Preferably, the block in contact with the application surface 15 consists of a block of compressible foam. Still advantageously, the flow of the applicator is increased by causing it to pass axially via a very narrow channel (not shown) or via one or more narrow slots. The operation of the device according to this embodiment is identical to the operation of the embodiment in FIGS. 1A–1C and, consequently, requires no additional detailed description.

Figure 6:
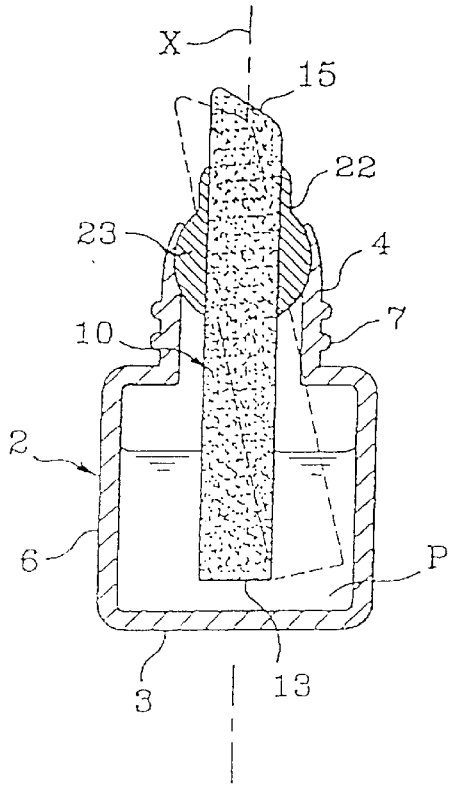
FIG. 6 illustrates yet another embodiment of the device according to the invention.

In the embodiment in FIG. 6, the applicator is fitted in the neck 4 by means of an intermediate piece 22 acting as a pivot 23. Such a pivot 23 makes it possible, as illustrated by broken lines, to pivot the applicator 10 with respect to the axis X of the flask. This facilitates the application hand movement. The reservoir may be made from metal, glass or from a thermoplastic material chosen from polyethylenes, polypropylenes, polyvinyl chlorides, polyethylene terephthalates, etc. The other parts of the device and its operation are in accordance with that described above.

Figure 7A:
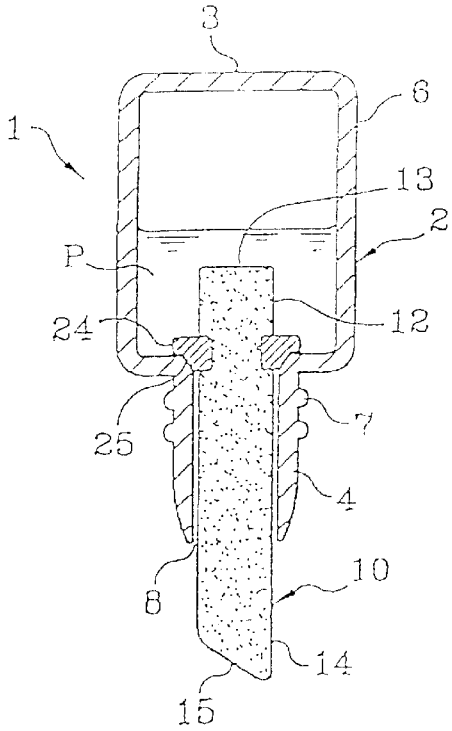
FIGS. 7A–7B illustrate yet another embodiment of the device according to the invention.
Figure 7B:
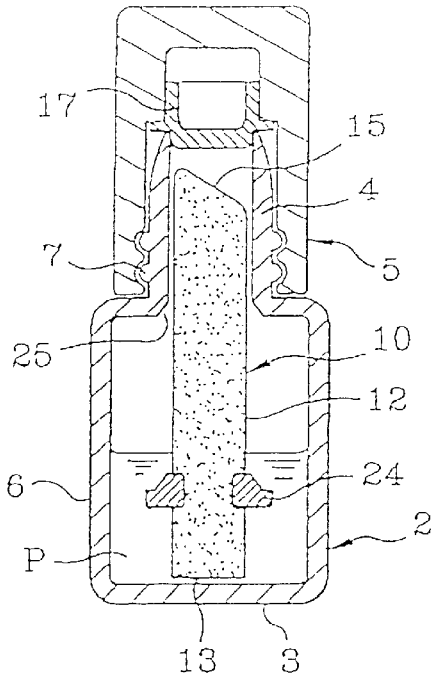

In the embodiment in FIGS. 7A and 7B, the foam is fitted so as to slide inside the neck 4. In this embodiment, the movement from the application position (FIG. 7A) to the "return" position (FIG. 7B,) and vice versa, takes place by the applicator sliding in the neck 4 of the flask 1. To this end, the applicator is equipped with a weight 24 fastened to the applicator inside the reservoir. The weight is fitted to the applicator so as to allow the applicator to travel from 3 mm to 15 mm and preferably from 5 mm to 10 mm. The weight may be fixed by gluing or by any other appropriate means. When the user wishes to apply the product P to a surface, she removes the cap 5 and turns the flask upside down, which has the result, via the weight 24, of moving the applicator downwards and causing the exit of the application surface 15 from the opening 8. At its surface facing the neck 4 of the flask, the weight has a frustoconical profile capable of forcibly engaging a complementary frustoconical part 25 provided on the lower part of the neck 4 so as to immobilize the applicator in the application position, this immobilization allowing the compression of at least part of the applicator for application of the product and the subsequent pumping of product when the pressure exerted on the application surface is relaxed. The applicator may then be used irrespective of the position of the flask. The method of application is identical to that described with reference to FIGS. 2A and 2B. After use, the user causes the applicator to return into the neck of the flask by exerting a pressure on the application surface 15 by means of the top 5. The applicator falls, due to the weight, into the base of the reservoir 2. The seal is provided only by the presence of the foam applicator in the neck 4 of the flask. However, complementary means may be provided to improve leaktightness.

Figure 8:
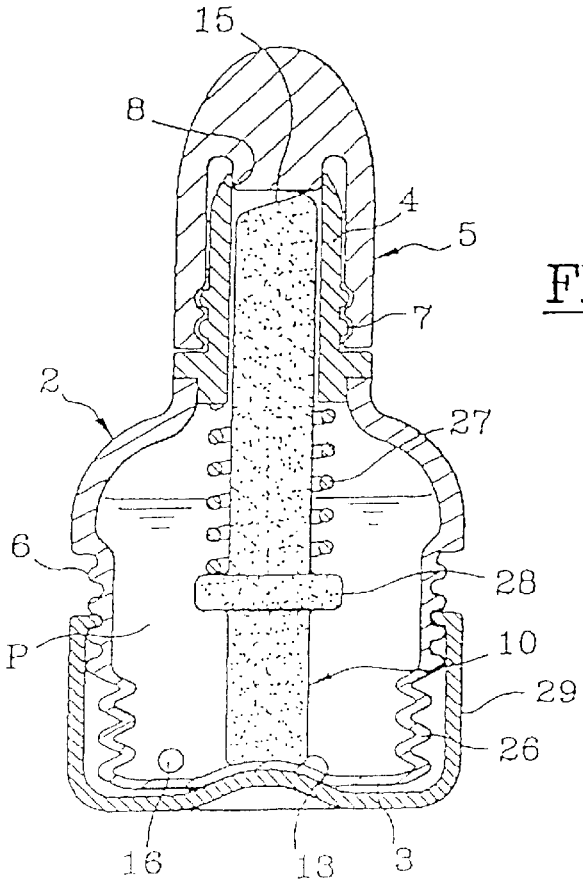
FIG. 8 illustrates still a further embodiment of the device according to the invention.

In the embodiment in FIG. 8, the applicator 10 is moved from the application position by pressure exerted on the base 3 of the reservoir. To this end, the base 3 is connected to the body 6 of the reservoir 2 by means of a bellows-type structure 26. The end 13 of the applicator is in contact with the base 3. A helicoidal spring 27 is provided on the applicator. A first end of the spring bears against a shoulder located between the body 6 of the reservoir 2 and the neck 4 . The other end of the spring bears against a projecting part 28 carried by the applicator. The projecting part 28 may consist of an attached piece, for example glued onto the applicator, or of an annular extra thickness formed by the applicator in the case of a foam with sufficient hardness. An attached base 29 is screwed onto the body 6 of the reservoir 2. Screwing the attached base relative to the body 6 causes the base 3 to rise, the bellows to be compressed, the applicator to rise in the neck, the spring 27 to be compressed and the application surface to exit through the opening 8. As appropriate, depending on the force of the spring relative to the hardness of the foam, part of the applicator may also be compressed. The applicator is then used in the manner shown in FIGS. 2A and 2B. After use, the user screws the attached base in the opposite direction, which causes the base to move away from the body 6 as far as a limit position. The applicator is returned into the base of the reservoir 2 by spring force, this return causing, if appropriate, decompression of the compressed part of the applicator and the pumping of product. The spring may be fitted both in extension and in compression. Alternatively, provision could be made for the end of the applicator to be secured to the inner surface of the base 3. In the embodiment shown, in the closed position of the top 5, the applicator is not substantially compressed. According to a variant, at least the end 14 of the applicator in the closed position of the top, can be in compression so as to create a supplementary pumping effect upon opening. This also applies to the embodiment in FIGS. 7A and 7B.

Figure 9:
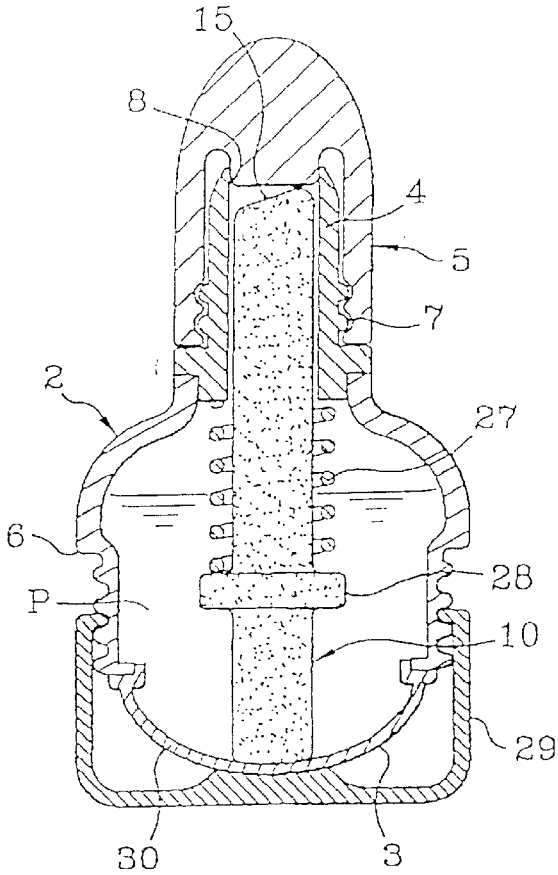
FIG. 9 illustrates a variant of the embodiment in FIG. 8.

The device in FIG. 9 is a variant of the embodiment in FIG. 8. According to this variant, the bellows 26 is dispensed with, the base 3 having the form of an attached piece 30 made from elastically deformable material of the elastomeric type. The attached piece 30 may be screwed, glued, snap-fitted, welded or produced by two-shot injection molding. The operation of the unit is identical to that of the embodiment in FIG. 8 and consequently requires no supplementary detailed description.

The packaging and application unit according to the invention is particularly advantageous in that it also allows the use of formulations requiring a high degree of hygrometry in order not to coagulate, particularly polymer-based formulations, this being, in particular, on account of the permanent saturation of the applicator. Such formulations would inevitably dry out in conventional devices.

In the preceding detailed description, reference was made to preferred embodiments of the invention. Obviously, variants of the invention may be provided without departing from the spirit of the invention as claimed below.

What is claimed is:

1. A unit for packaging and applying a liquid product, comprising:

a reservoir containing the product and having an opening;

a removable closure for closing off said opening in a leaktight manner;

an applicator fitted inside the reservoir and including a first end in liquid communication with the product inside the reservoir and a second end opposite said first end, said second end forming an application surface which is movable axially between a first position in which the application surface emerges outside the reservoir through said opening, and a second position in which said application surface is contained in a leaktight manner inside the reservoir, wherein said applicator comprises at least one block of an absorbent material which is capable of being at least partially compressed, and wherein said applicator is mounted to the reservoir such that said applicator is saturated with the product when said second end moves from said second position to said first position.

2. The unit according to claim 1, wherein the absorbent material includes open cells with an average size of from 200 $\mu$m to 3 mm.

3. The unit according to claim 1, wherein the reservoir comprises a body with a first end closed at a base and wherein the body further comprises a second end surmounted by a neck, said opening being delimited by a free edge of the neck, wherein the applicator is at least partially inside the neck.

4. The unit according to claim 3, wherein the neck has an axis which is different from the axis of the reservoir.

5. The unit according to claim 3, wherein the first end of said applicator extends substantially inside the body and is located above a level of product in the reservoir.

6. The unit according to claim 5, wherein the base is mounted to be movable axially with respect to the body so as to facilitate contact between the product and the applicator and to promote loading of the applicator with product.

7. The unit according to claim 6, wherein the base is connected to the body by a bellows.

8. The unit according to claim 6, including a spring bearing against the base and the applicator.

9. The unit according to claim 1, wherein the applicator is connected to a wick soaking in the product.

10. The unit according to claim 3, wherein an intermediate portion of said applicator between said first and second ends is secured to the neck, and wherein movement of the application surface from the first position to the second position is due to axial compression of at least the portion of the applicator which is between the application surface and the intermediate portion in response to closing said opening by said removable closure.

11. The unit according to claim 10, wherein said applicator is secured to the neck by one of gluing and welding.

12. The unit according to claims 3, wherein the applicator is fitted so as to slide inside the neck, and wherein movement of the application surface from the first position to the second position is due to an axial translation movement of the entire applicator.

13. The unit according to claim 12, including a ballast provided on the applicator, wherein axial translation movement of the entire applicator is due to the weight of the ballast.

14. The unit according to claim 13, including means for locking said applicator in said first position.

15. The unit according to claim 12, wherein the first end of the applicator is located in the vicinity of the base, further comprising means for selectively varying an axial distance between the base and the neck so as to cause the applicator to move from one of the first and second positions to the other, and means for holding the first end of the applicator in contact with the base.

16. The unit according to claim 15, wherein the base is connected to the body by a bellows.

17. The unit according to claim 15, wherein the base comprises an elastically deformable flexible membrane.

18. The unit according to claim 15, wherein said means for selectively varying the axial distance between the base and the neck comprises a further base which is screwed onto the body.

19. The unit according to claim 15, wherein said means for holding the first end of the applicator in contact with the base includes an elastic return spring, a first end of which bears against a zone located in the vicinity of the neck and a second end of which bears on a zone secured to the applicator.

20. The unit according to claim 3, wherein said applicator is held via an intermediate member fitted inside the neck.

21. The unit according to claim 20, wherein the intermediate member is held inside the neck via one of snap-fitting, screwing, gluing and welding.

22. The unit according to claim 1, wherein in the second position, the applicator is at least partially compressed inside the reservoir.

23. The unit according to claim 1, wherein the reservoir has a base opposite said opening, the first end being located substantially in the vicinity of the base so as to be permanently in contact with the product.

24. The unit according to claim 1, wherein the applicator is mounted so as to pivot angularly with respect to an axis of the reservoir.

25. The unit according to claim 24, wherein the applicator is mounted via a pivot mechanism.

26. The unit according to claim 1, wherein the applicator comprises at least one block of foam chosen from polyurethane, polyethylene, polyvinyl chloride, polyether, polyester.

27. The unit according to claim 26, wherein the applicator comprises at least 10% open or semi-open cells.

28. The unit according to claim 1, wherein the applicator comprises a stack of blocks of foam of different characteristics.

29. The unit according to claim 1, wherein the applicator comprises a stack of at least one block of foam and at least one block of a material chosen from sintered materials of polyvinyl chloride, ethylene-vinyl acetate and felts.

30. The unit according to claim 1, wherein the application surface has a shape which is one of concave, convex, flat, bevelled and double-bevelled.

31. The unit according to claim 1, wherein the application surface is covered with one of a permeable textile, perforated plastic, felt and a flock coating.

32. The unit according to claim 31, wherein the flock coating comprises pile fibers of different characteristics.

33. The unit according to claim 1, wherein the applicator has a substantially central narrowed portion, so as to increase its product-application capacity.

34. The unit according to claim 1, wherein the reservoir is made from one of metal, glass, and a thermoplastic material.

35. The unit according to claim 34, wherein the thermoplastic material is one of polyethylenes, polypropylenes, polyvinyl chlorides and polyethylene terephthalates.

36. The unit according to claim 1, including an element provided inside the reservoir so as to promote homogenization of the product and to facilitate loading of the applicator.

37. The unit according to claim 1, including two of said applicators mounted head-to-tail inside the reservoir.

38. The unit according to claim 1,.wherein the product is a cosmetic product.

39. The unit according to claim 38, wherein the product is one of nail varnish, lipstick, an oil, a gel-type oil, a glue, a writing corrector and a stain remover.

40. The unit according to claim 1, wherein the absorbent material includes open cells with an average size of from 700 $\mu$m to 2 mm.

41. The unit according to claim 1, wherein the absorbent material includes open cells with an average size of from 0.1 mm to 1.5 mm.

42. A unit for packaging and applying a liquid product, comprising:

a variable volume reservoir containing the product and having an opening;

a removable closure for closing off said opening in a leaktight manner; and an applicator fitted inside the reservoir and including a first end in liquid communication with the product inside the reservoir and a second end opposite said first end, said second end forming an application surface which is movable axially between a first position in which the application surface emerges outside the reservoir through said opening, and a second position in which said application surface is contained in a leaktight manner inside the reservoir, wherein said applicator comprises at least one block of an absorbent material which is capable of being at least partially compressed, and wherein the reservoir comprises a body having a deformable first end, wherein the applicator is positioned in the reservoir to be at least partially compressed by deformation of the body.

43. The unit according to claim 42, wherein the first end of said body is closed at a base and wherein the body further comprises a second end surmounted by a neck, said opening being delimited by a free edge of the neck, wherein the applicator is at least partially inside the neck.

* * * * *

UNITED STATES PATENT AND TRADEMARK OFFICE

CERTIFICATE OF CORRECTION

PATENT NO. : 6,386,781 B1
DATED : May 14, 2002
INVENTOR(S) : Jean-Louis H. Gueret It is certified that error appears in the above-identified patent and that said Letters Patent is hereby corrected as shown below:

Column 12,
Line 55, after "polyester" insert -- , natural rubber and synthetic rubber --.

Signed and Sealed this

First Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,386,781 B1
APPLICATION NO. : 09/055899
DATED : May 14, 2002
INVENTOR(S) : Gueret It is certified that error appears in the above-identified patent and that said Letters Patent is hereby corrected as shown below:

Title page,
Item [*] Notice, delete "0" and insert -- 208 --.

Signed and Sealed this

Twentieth Day of June, 2006

JON W. DUDAS
*Director of the United States Patent and Trademark Office*